US005811801A

United States Patent [19]

Tsuno

[11] Patent Number: 5,811,801

[45] Date of Patent: Sep. 22, 1998

[54] OMEGA-TYPE ENERGY FILTER

[75] Inventor: Katsushige Tsuno, Tokyo, Japan

[73] Assignee: JEOL Ltd., Tokyo, Japan

[21] Appl. No.: 757,209

[22] Filed: Nov. 27, 1996

[51] Int. Cl.[6] ..... H01J 49/46

[52] U.S. Cl. ..... 250/305; 250/396 ML

[58] Field of Search ..... 250/305, 396 ML, 250/396 R, 311, 310

[56] References Cited

U.S. PATENT DOCUMENTS

| | | | |
|---|---|---|---|
| 4,740,704 | 4/1988 | Rose et al. | 250/396 ML |
| 5,126,565 | 6/1992 | Rose | 250/305 |
| 5,177,361 | 1/1993 | Krahl et al. | 250/305 |
| 5,449,914 | 9/1995 | Rose et al. | 250/305 |
| 5,585,630 | 12/1996 | Taniguchi et al. | 250/305 |

OTHER PUBLICATIONS

"High–Resolution imaging magnetic energy filters with simple structure", S. Lanio, *Optik 73,* No. 3 (1986), pp. 99–107.

*Primary Examiner*—Kiet T. Nguyen

*Attorney, Agent, or Firm*—Webb Ziesenheim Bruening Logsdon Orkin & Hanson, P.C.

[57] ABSTRACT

An omega-type energy filter of the B-type in which a beam of charged-particles is focused three times in a direction perpendicular to the direction of magnetic fields and twice in the direction of the magnetic fields. The geometry is so designed that this B-type produces smaller aberrations and larger energy dispersion than the A-type. The filter has four sector magnets $M_1$, $M_2$, $M_3$, and $M_4$ for successively deflecting the charged-particle beam passed through an entrance aperture and for directing the beam toward an exit slit. The entrance aperture and the exit slit are arranged symmetrically with respect to a central, symmetrical plane. The sector magnets $M_1$ and $M_4$ are arranged symmetrically with respect to the symmetrical plane. The sector magnets $M_2$ and $M_3$ are arranged symmetrically with respect to the symmetrical plane. The entrance aperture and the entrance face of the sector magnet $M_1$ are separated by a distance of $L_5$. The exit face of the sector magnet $M_4$ and the exit slit are separated by the same distance of $L_5$. Relations given by $$50\text{ mm} \geqq L_5/\sqrt{(U^*/239)} \geqq 40\text{ mm}$$

are satisfied.

6 Claims, 11 Drawing Sheets

Yβ
Y

Xα
X

M1
M2
M3
M4
SYMMETRICAL PLANE
APERTURE PLANE
SLIT PLANE
LL
IMAGE PLANE
IMAGE PLANE
LL
Yδ

Xγ

L1
M1
L2
M2
L3
L3
M3
L4
M4
L5

OMEGA-TYPE ENERGY FILTER

FIELD OF THE INVENTION

The present invention relates to an Ω (omega-type) energy filter designed to focus a beam of charged-particles three times in the x-direction normal to the magnetic field direction and two times in the y-direction (i.e., the magnetic field direction).

BACKGROUND OF THE INVENTION

An electron microscope incorporating an omega-type energy filter is shown in FIG. 7, where an electron gun 11 emits an electron beam. This beam is directed at a specimen 14 via a condenser lens 12 and via an objective lens 13. The electron beam is transmitted through the specimen while modulated by it. Then, the beam reaches a fluorescent plate 20 after passing through an intermediate lens 15, an entrance aperture 16, an omega-type energy filter 17, a slit 18, and a projector lens 19. As a result, a TEM image based on the electrons which have been transmitted through the energy filter and thus have certain energies is formed on the fluorescent screen.

FIGS. 8 and 9 are electron optical ray diagrams of omega-type energy filters. In each of these two figures, four sector magnets and an electron orbit are drawn. In these electron optical ray diagrams, the direction of travel of electrons is taken as the z-direction in a conventional manner. The direction which is perpendicular to the direction of travel of electrons and is located within a plane parallel to the magnetic pole pieces where the electron orbit exists is taken as the x-direction. The direction (the direction of the magnetic field) perpendicular to both x- and z-directions is taken as the y-direction.

As shown in FIGS. 8 and 9, an omega-type energy filter comprises four sector magnets $M_1$, $M_2$, $M_3$, and $M_4$, where the beam shows radii of curvature $R_1$, $R_2$, $R_3$, and $R_4$, respectively. These sector magnets create an omega-shaped electron orbit. Normally, the energy filter is so designed that the incident beam and outgoing beam pass along a common electron optical axis. A symmetrical plane is located midway between the sector magnets $M_2$ and $M_3$ and is perpendicular to the electron optical axis. The entrance aperture and the slit are arranged symmetrically with respect to the symmetrical plane. Also, the magnets $M_1$ and $M_4$ are arranged symmetrically with respect to the symmetrical plane. Furthermore, the magnets $M_2$ and $M_3$ are arranged symmetrically with respect to the symmetrical plane.

FIGS. 10A, 10B, 10C and 10D show four kinds of electron orbits xα, yβ, xγ, and yδ used in the energy filter shown in FIG. 8. In the electron orbit xγ, the height in the x-direction is zero at the position of the entrance aperture (aperture plane). In the electron orbit yδ, the height in the y-direction is zero at the position of the exit slit (slit plane) . In the electron orbit xα, the height in the x-direction is zero at the imaging position (imaging planes) within the filter. In the electron orbit yβ, the height in the y-direction is zero at the imaging position within the filter.

It can be seen from FIG. 10 that in the geometry of FIG. 8, focusing is done three times in the x-direction if the electron orbit xα is employed and three times in the y-direction if the electron orbit yβ is exploited. The geometry of FIG. 8 is normally known as the A-type.

Similarly, in the case of the geometry of FIG. 9, focusing is done three times in the x-direction if the electron orbit xα shown in FIG. 11A is used and twice in the y-direction if the electron orbit yβ is used. The geometry of FIG. 9 is normally known as the B-type.

Where an image is focused onto the fluorescent screen 20, electron microscope diffraction images are formed at the aperture plane and also at the slit plane. The image must be achromatic, but a real achromatic image formed inside the filter is not stigmatic. Only the image which is formed after passing through a round lens placed behind the slit is achromatic and stigmatic image.

The omega-type energy filter is designed so that the beam orbit is symmetrical with respect to the plane located midway between the second magnet $M_2$ and the third magnet $M_3$ as described previously in order that some of the second-order aberrations be reduced down to zero and the other aberrations be reduced. More specifically, let LL be the distance between the final image plane inside the filter and the slit plane. The optics of the filter is so adjusted that the image plane that incident electrons first encounter is at the distance LL from the aperture plane. Under these conditions, the A-type and the B-type differ in the following respects. In the orbit extending in the y-direction (the direction of the magnetic field), the A-type satisfies equations given by $y\beta=0$ and $y\delta'=0$, as shown in FIGS. 10B and 10D, at the symmetrical plane, whereas the B-type meets equations given by $y\beta'=0$ and $y\delta=0$, as shown in FIGS. 11B and 11D, at the symmetrical plane. The prime (') indicates a derivative with respect to Z, i.e., the tilt of the orbit. With respect to the electronic orbit running in the x-direction, both types cater for the relations $x\alpha=0$ and $x\gamma'=0$ at the symmetrical plane.

If these initial conditions are selected, in the A-type, the xγ orbit is focused three times and the yδ orbit is focused three times, as shown in FIG. 10C and 10D. On the other hand, in the B-type, the xγ orbit is focused three times but the yδ orbit is focused only twice, as shown in FIGS. 11C and 11D. Consequently, the image is reversed.

These two types of Ω energy filters have been known for many years but most energy filters developed heretofore are of the A-type, because the B-type suffers from large second-order aberrations, as reported by S. Lanio in "High-resolution imaging magnetic energy filters with simple structure", Optik 73 (1986), pp. 99–107.

However, the B-type has the advantage that the number of convergences in the y-direction is fewer than the A-type by one. Under a uniform magnetic field, electrons undergo a focusing action in a direction vertical to the magnetic field but do not in the direction of the magnetic field. Therefore, the end surface, or face, of the magnet is inclined at an angle to the incident (or outgoing) direction of the beam so as to form a fringe lens. Thus, a focusing action is produced in the y-direction. This focusing action functions like a convex lens in the y-direction and like a concave lens in the x-direction, as can be seen from FIGS. 10A–10D and 11A–11D. Accordingly, in order to focus the electrons three times in the y-direction, the sum of the face tilt angles must be sufficient to focus the electrons three times. Increasing the face tilt angles tends to incur greater aberrations. Also, a concave lens is inevitably produced in the x-direction. Therefore, the uniform field portion must produce a converging action which is strong enough to compensate for the divergence produced by the concave lens. Accordingly, the aforementioned decrease in the number of convergences in the y-direction should essentially increase the number of degrees of freedom in designing the whole system. The conventional concept that the B-type results in greater aberrations is erroneous.

SUMMARY OF THE INVENTION

The present invention is intended to solve the foregoing problems. It is an object of the present invention to provide an omega-type energy filter which is based on the B-type omega-type energy filter and appropriately shaped so as to produce smaller aberrations and greater energy dispersion than the A-type omega-type energy filter.

The present invention provides an omega-type energy filter comprising an entrance aperture, four sector magnets $M_1$, $M_2$, $M_3$, and $M_4$, and an exit slit. A charged-particle beam accelerated at U eV is entered from the entrance aperture, deflected by the four sector magnets successively, and directed to the exit slit. The entrance aperture and the exit slit are arranged symmetrically with respect to a center plane located at the center of the filter. Also, the sector magnets $M_1$ and $M_4$ are arranged symmetrically with respect to the center plane. The sector magnets $M_2$ and $M_3$ are arranged symmetrically with respect to the center plane. Electrons are focused three times in the x-direction perpendicular to the magnetic field and twice in the y-direction, or in the direction of the magnetic field. The sector magnet $M_1$ has an entrance face which is spaced from the entrance aperture by a distance of $L_5$. The sector magnet $M_4$ has an exit face which is spaced from the exit slit also by a distance of $L_5$. This filter is characterized in that it satisfies relations given by $$50\text{ mm} \geqq L_5/\sqrt{(U^*/239)} \geqq 40\text{ mm}$$

It is assumed that the sector magnets $M_2$ and $M_3$ rotate the beam at a radius of curvature $R_3$ and that the sector magnets $M_1$ and $M_4$ rotate the beam at a radius of curvature $R_4$. In another feature of the invention, the relation $R_3>R_4$ holds.

The first image plane is spaced from the entrance aperture by a distance of LL. An image located immediately ahead of the exit slit is spaced from the exit slit also by a distance of LL. In a further feature of the invention, the following relations are satisfied:

$$55\text{ mm} \leqq LL/\sqrt{(U^*/239)} \leqq 90\text{ mm}$$

The sector magnets $M_2$ and $M_3$ facing the symmetrical plane are spaced from the sector magnets $M_1$ and $M_4$, respectively, by a distance of $L_4$. The sector magnets $M_1$ and $M_4$ face the entrance aperture and the exit slit, respectively. In a still other feature of the invention, the following relations are satisfied:

$$40\text{ mm} \leqq L_4/\sqrt{(U^*/239)} \leqq 70\text{ mm}$$

Other objects and features of the invention will appear in the course of the description thereof, which follows.

DETAILED DESCRIPTION OF THE INVENTION

Figure 1A:
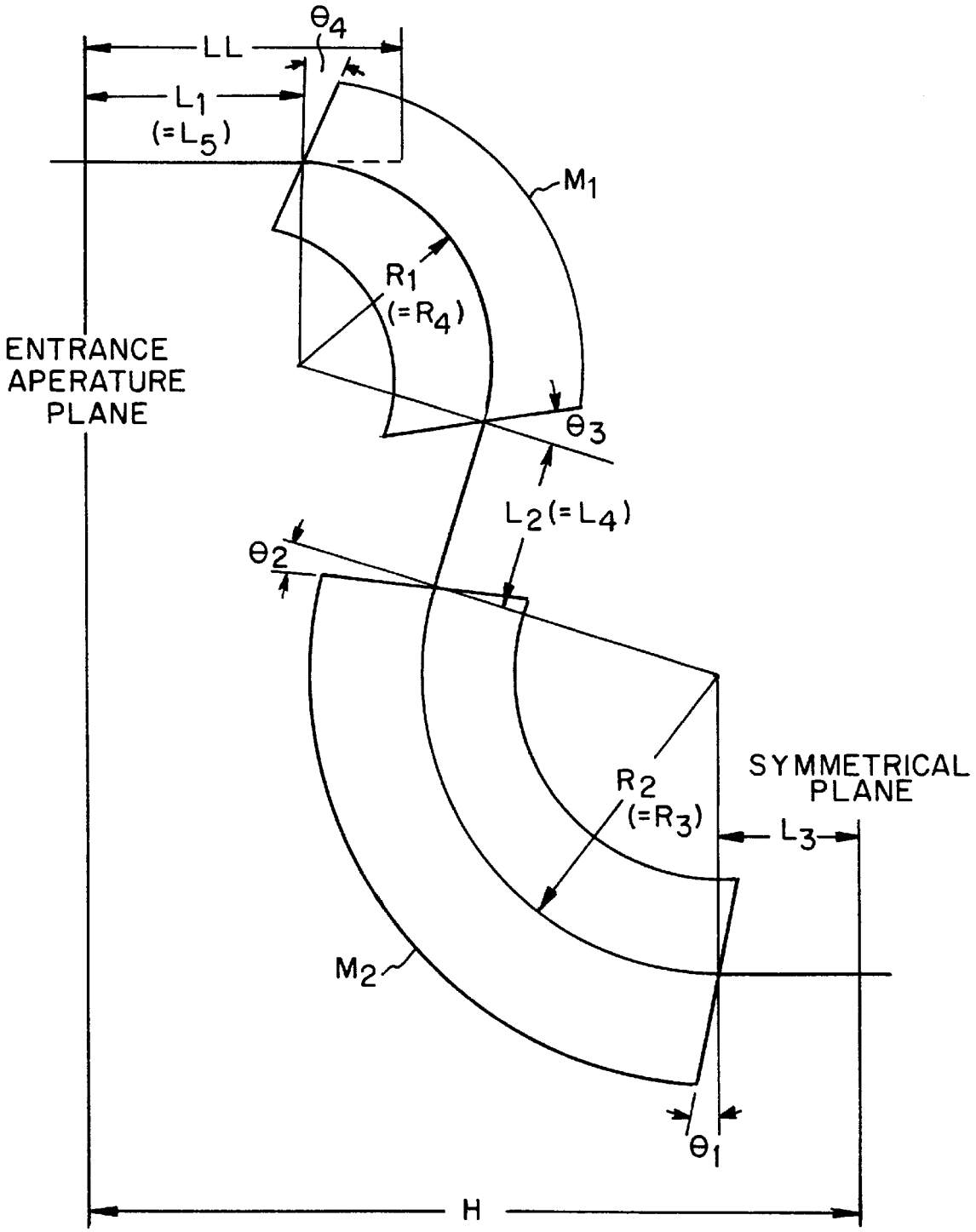
FIGS. 1A and 1B are electron optical ray diagrams illustrating fundamental parameters of an omega-type energy filter according to the present invention.
Figure 1B:
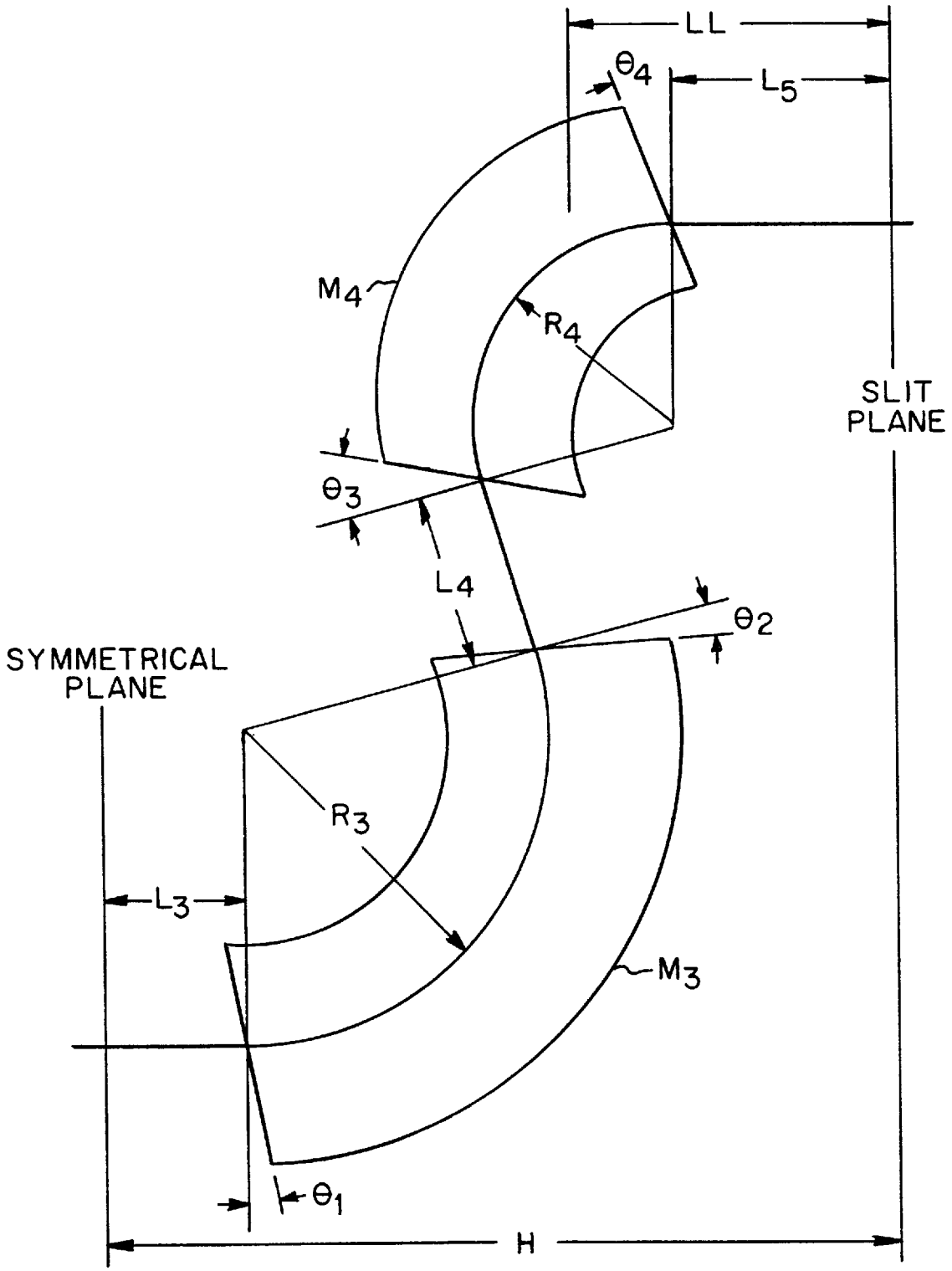
Figure 2:
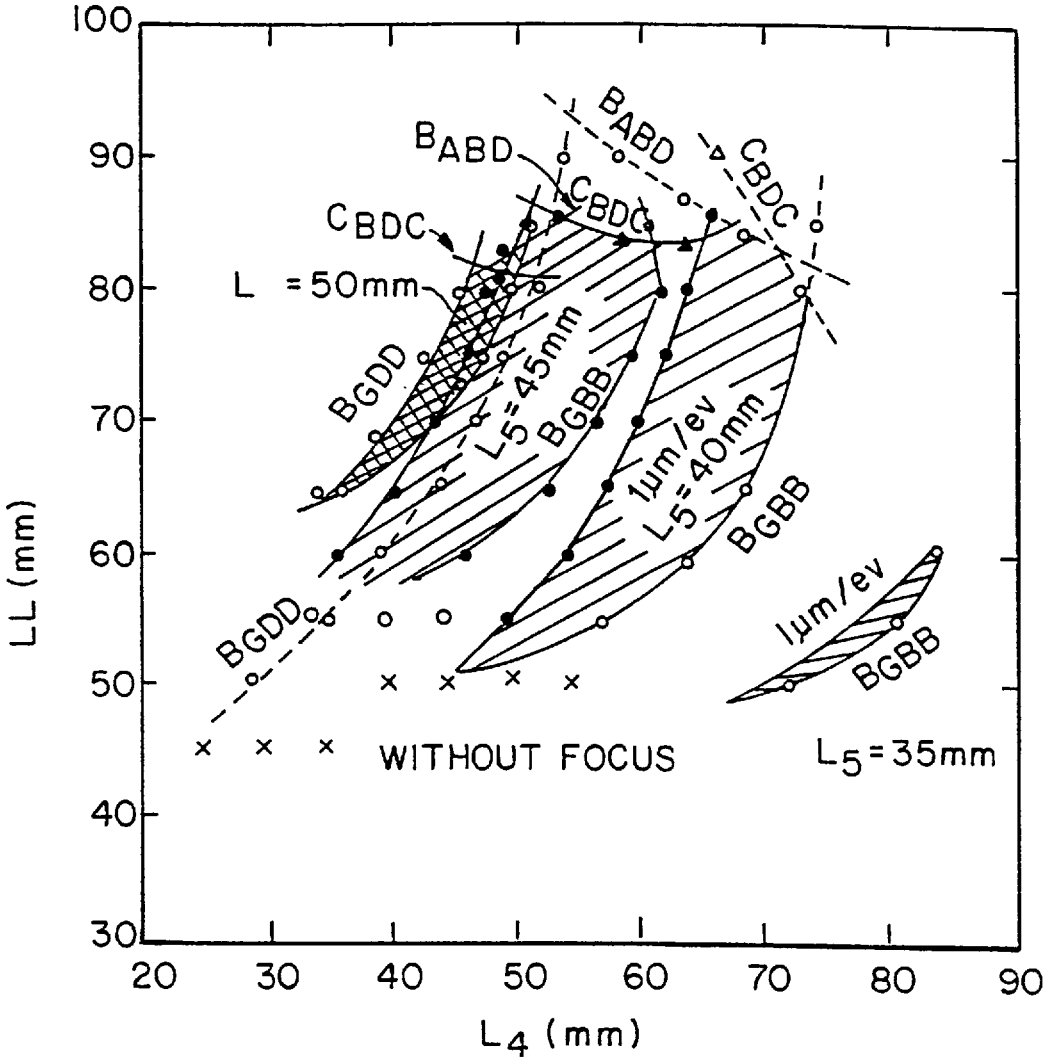
FIG. 2 is a graph illustrating regions where every aberration coefficient is less than 1000 and the energy dispersion is in excess of 1 $\mu$m/eV.

Referring to FIGS. 1A and 1B, there is shown an omega-type energy filter according to the concept of the present invention, illustrating its fundamental parameters. FIG. 2 shows regions where every aberration coefficient is less than 1000 and the energy dispersion is in excess of 1 $\mu$ it m/eV. FIG. 1A shows the configuration from the entrance aperture to the symmetrical plane. FIG. 1B shows the configuration from the symmetrical plane to the exit slit.

As shown in FIGS 1A and 1B, the energy filter comprises sector magnets $M_1$–$M_4$ in which the center orbit of a charged-particle beam is deflected at radii of curvature of $R_1$–$R_4$, respectively. The exit face of the sector magnet $M_2$ and the entrance face of the sector magnet $M_3$ are tilted at an angle of $\theta_1$ to the center orbit. The entrance face of the sector magnet $M_2$ and the exit face of the sector magnet $M_3$ are tilted at an angle of $\theta_2$ to the center orbit. The exit face of the sector magnet $M_1$ and the entrance face of the sector magnet $M_4$ are tilted at an angle of $\theta_3$ to the center orbit. The entrance face of the sector magnet $M_1$ and the exit face of the sector magnet $M_4$ are tilted at an angle of $\theta_4$ to the centeir orbit.

Let $L_1$ be the distance between the entrance aperture plane and the entrance face of the sector magnet $M_1$. Let $L_2$ be the distance between the exit face of the sector magnet $M_1$ and the entrance face of the sector magnet $M_2$. The exit face of the sector magnet $M_2$ and the entrance face of the sector magnet $M_3$ are equidistant from the symmetrical plane and separated by a distance of $L_3$. Let $L_4$ be the distance between the exit face of the sector magnet $M_3$ and the entrance face of the sector magnet $M_4$. Let $L_5$ be the distance between the exit face of the sector magnet $M_4$ and the exit slit plane. Let LL be the distance between the entrance aperture plane and the initial image place. The distance between the exit slit plane and the final image plane is set to LL. Because of the symmetry with respect to the symmetrical plane, equations $L_1=L_5$, $L_2=L_4$, $R_1=R_4$, and $R_2=R_3$ hold.

Geometrical factors determining the fundamental optical characteristics of the omega-type energy filter are ten, i.e., the aforementioned radii of curvature $R_1$ (=$R_4$), $R_2$ (=$R_3$), $R_3$, $R_4$, tilt angles of the faces $\theta_1$, $\theta_2$, $\theta_3$, $\theta_4$, distances $L_1$ (=$L_5$), $L_2$ (=$L_4$), $L_3$, $L_4$, $L_5$, and LL. The distance between the actual end surface of a magnet and the effective end surface of the magnetic field distribution might be another parameter but this is neglected here. Of these 10 parameters, the tilt angles of the faces $\theta_1$, $\theta_2$, $\theta_3$, and $\theta_4$ are used to make adjustments for obtaining astigmatic focusing (i.e., the focal point agrees both in x- and y- directions) at image planes and diffraction planes. Instead, the distances $L_3$, $L_4$, $L_5$, etc. can be used for the adjustments.

Each face tilt angle $\theta$ is normally made to assume a positive value if the charged-particle beam passing across the end surface is converged in the y-direction. Empirically, if $\theta_n$ (such as $\theta_1$, $\theta_2$, $\theta_3$, $\theta_4$) is >45°, then aberrations are increased greatly or astigmatic focusing does not occur under any condition. Therefore, each face tilt angle $\theta_n$ is selected to be less than 45°. The beam is converged in the y-direction where $\theta_1, \theta_2, \theta_3, \theta_4>0$, as mentioned previously. Consequently, if one face tilt angle is selected to be negative, then the other face tilt angles must be made large. In this case, angles less than 10° are tolerated. Thus, the allowable angle range is given by $$-10^\circ<\theta_1, \theta_2, \theta_3, \theta_4<45^\circ$$

The omega-type energy filter of the B-type has 10 geometrical aberrations (such as distortions, aperture aberrations, and other aberrations and given by $A_{AAA}$, $A_{AAG}$, $A_{AGG}$, $A_{GGG}$, $B_{ABB}$, $B_{ABD}$, $B_{GBB}$, $B_{GBD}$, $B_{ADD}$, $B_{GDD}$) and 8 chromatic aberrations (caused by different energies and given by $C_{AA}$, $C_{BB}$, $C_{AG}$, $C_{BD}$, $C_{GG}$, $C_{DD}$, $C_{GE}$, $C_{AE}$), as described by Ludwig Reimer in "Energy-Filtering Transmission Electron Microscopy", Springer 1995, pp. 43–149; H. Rose, D. Krahl., "Electron Optics of Imaging Energy Filters". Of these aberrations, four aberrations $B_{ABD}$, $B_{GBB}$, $B_{GDD}$, and $C_{BD}$ tend to have large values. The accelerating voltage was set to 200 kV. If the values of these four aberrations are less than 1000, and if the energy dispersion $\lambda$ is in excess of 1 $\mu$m/eV (in the case of n kV, it is in excess of 200/ n $\mu$m/eV), then the filter conditions are regarded as good. We examined how these conditions varied for about these six parameters.

The most important parameter is the distance $L_5$ (=$L_1$). As can be seen from FIGS. 10A–10D and 11A–11D, image planes exist near the entrance face of the sector magnet Ml and near the exit face of the sector magnet $M_4$. Since no energy dispersion should take place (achromatic condition) at any image plane, large energy dispersion cannot be expected unless the distance $L_5$ is large. In FIG. 2, the distance $L_4$ is plotted on the horizontal axis and the distance LL on the vertical axis. Ranges satisfying the aforementioned conditions are plotted for several values of the distance $L_5$. As described previously, the energy dispersion is increased with increasing the distance $L_5$. It can be observed that the region satisfying the aberration conditions is narrow where $L_5$=50 mm. Where $L_5$=40 mm, the right portion of the graph is limited by the aberration $B_{GBB}$, while the left portion is restricted not by the aberration $B_{GDD}$ as in the case of $L_5$=45 mm but by energy dispersion 1 $\mu$m/eV.

More specifically, conditions giving small aberrations are present over a wide range. However, in many regions, the energy dispersion is no longer less than 1 $\mu$m/eV. This tendency becomes extreme where $L_5$=35 mm, and the range where the energy dispersion is in excess of 1 $\mu$m/eV is quite narrow. Therefore, it can be seen from the graph of FIG. 2 that the distance $L_5$ should satisfy the condition $$35\text{ mm}\leqq L_5\leqq 50\text{ mm}$$

Optimally, 35 mm$\leqq L_5 \leqq$45 mm.

Figure 3:
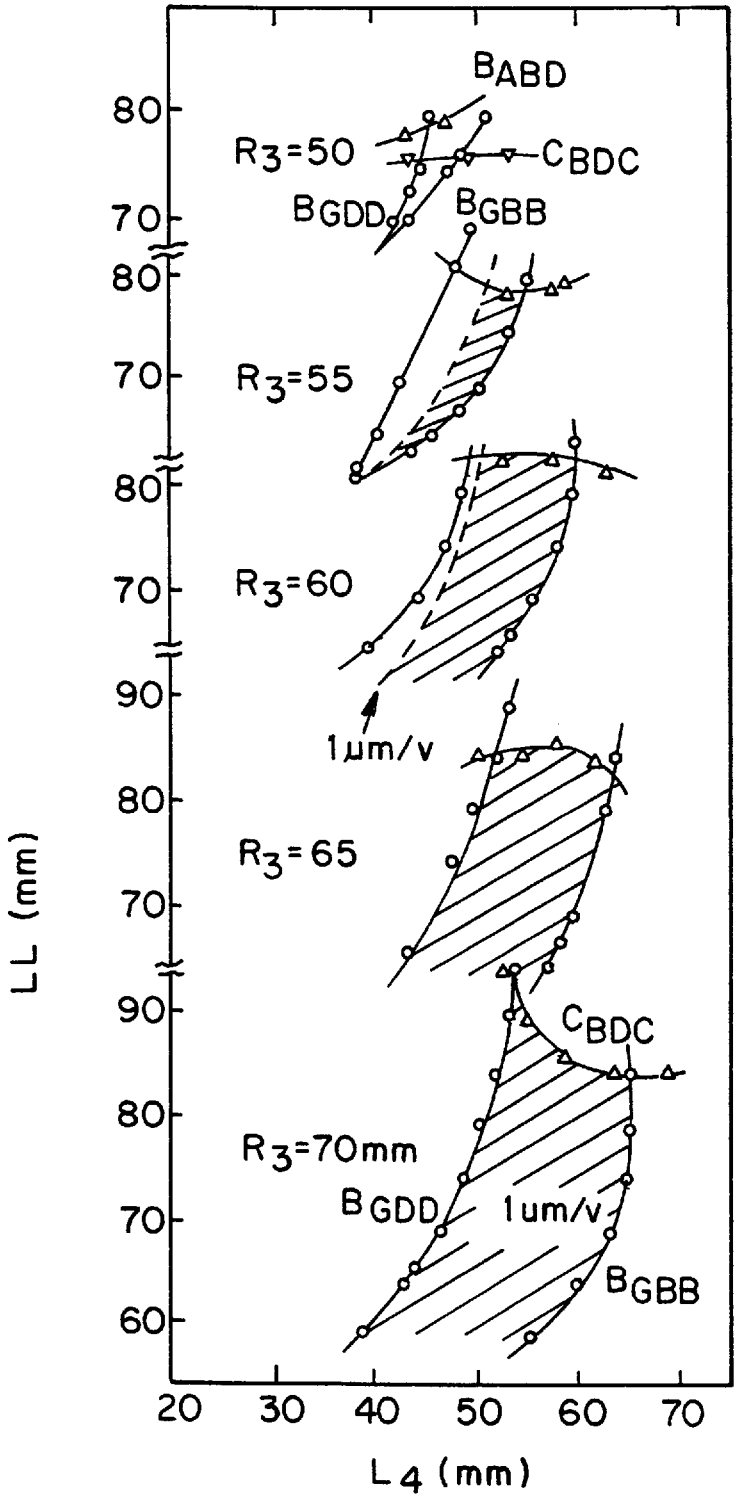
FIG. 3 is a graph in which distance LL of the energy filter own in FIGS. 1A and 1B is plotted against distance $L_4$ where the sector radius of the magnet $M_4$ is kept at 50 mm, illustrating values of the sector radius of the magnet $M_3$ which give low aberrations and great dispersion.
Figure 4:
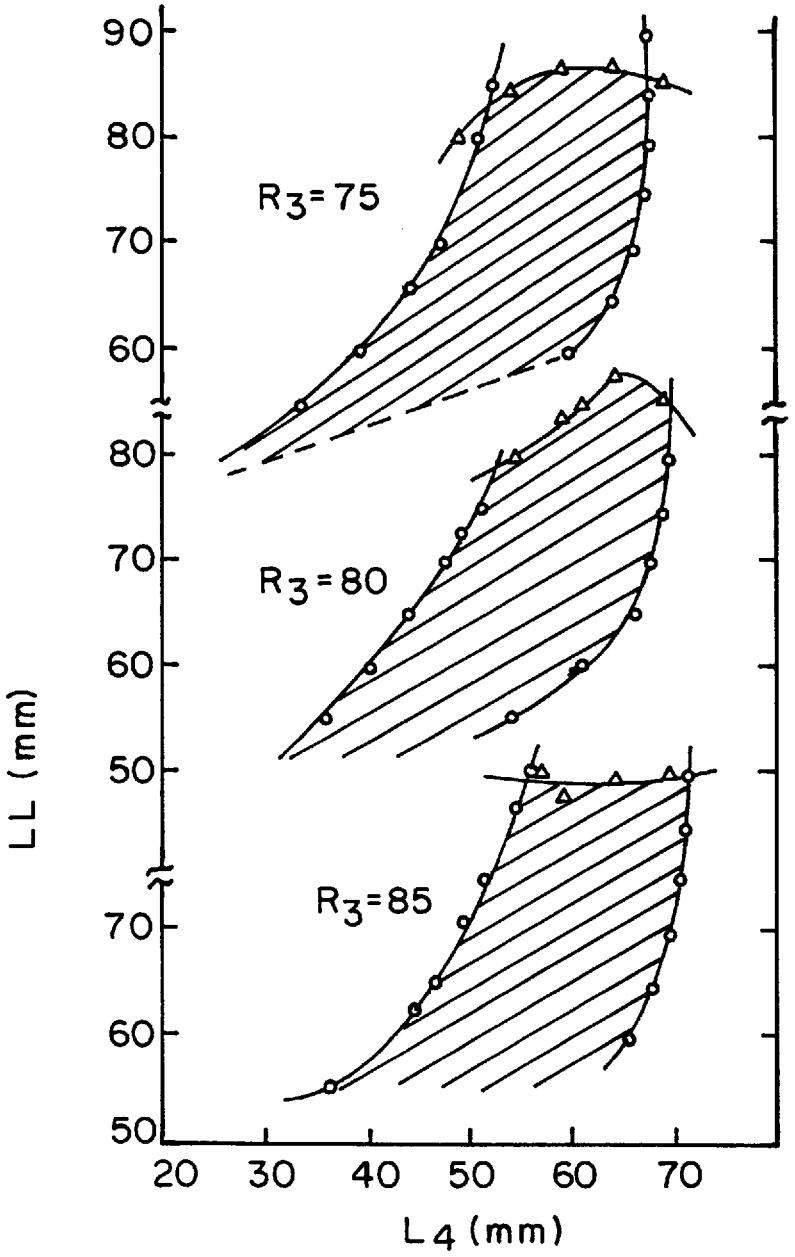
FIG. 4 is a graph similar to FIG. 3, but other values of the sector radius of the magnet $M_3$ are used.

The next most important parameter is the sector radii of the magnets. FIGS. 3 and 4 illustrate values of the sector radius $R_3$ (=$R_2$) of the magnet $M_3$ ($M_2$) which provide low aberrations and great dispersion where the sector radius $R_4$ (=$R_1$) of the magnet $M_3$ ($M_2$) is kept at 50 mm. The sector radius $R_3$ was varied in steps of 5 mm from 50 mm to 85 mm. Regions where the second-order aberrations are less than 1000 and the energy dispersion is in excess of 1 $\mu$m/eV at 200 kV are shown in the graphs, where the image plane-slit plane distance LL is plotted against the distance $L_4$. Where the accelerating voltage is n kV, the energy dispersion is in excess of (200/ n) $\mu$m/eV.

As can be seen from these graphs, the sector radii $R_3$ (=$R_2$) and $R_4$ (=$R_1$) must satisfy the relation $R_3>R_4$. No usable range exists where $R_3$=$R_4$. Where $R_3$ is equal to or greater than 65 mm, the energy dispersion is so great that the whole region is limited by the second-order aberrations.

This region is broadened with increasing the sector radius $R_3$ (=$R_2$). Of course, increasing the sector radius $R_3$ increases the whole size of the filter. Therefore, for optimum design, the sector radius should be reduced to a minimum without sacrificing the performance. Where the sector radius $R_3$ is greater than 60 mm, the region is interrupted at small values of the distance LL. This occurs where the astigmatic focusing conditions do not hold because the face tilt angle is greater than 45°. Within the indicated range, the astigmatic focusing conditions are met sufficiently.

Figure 5:
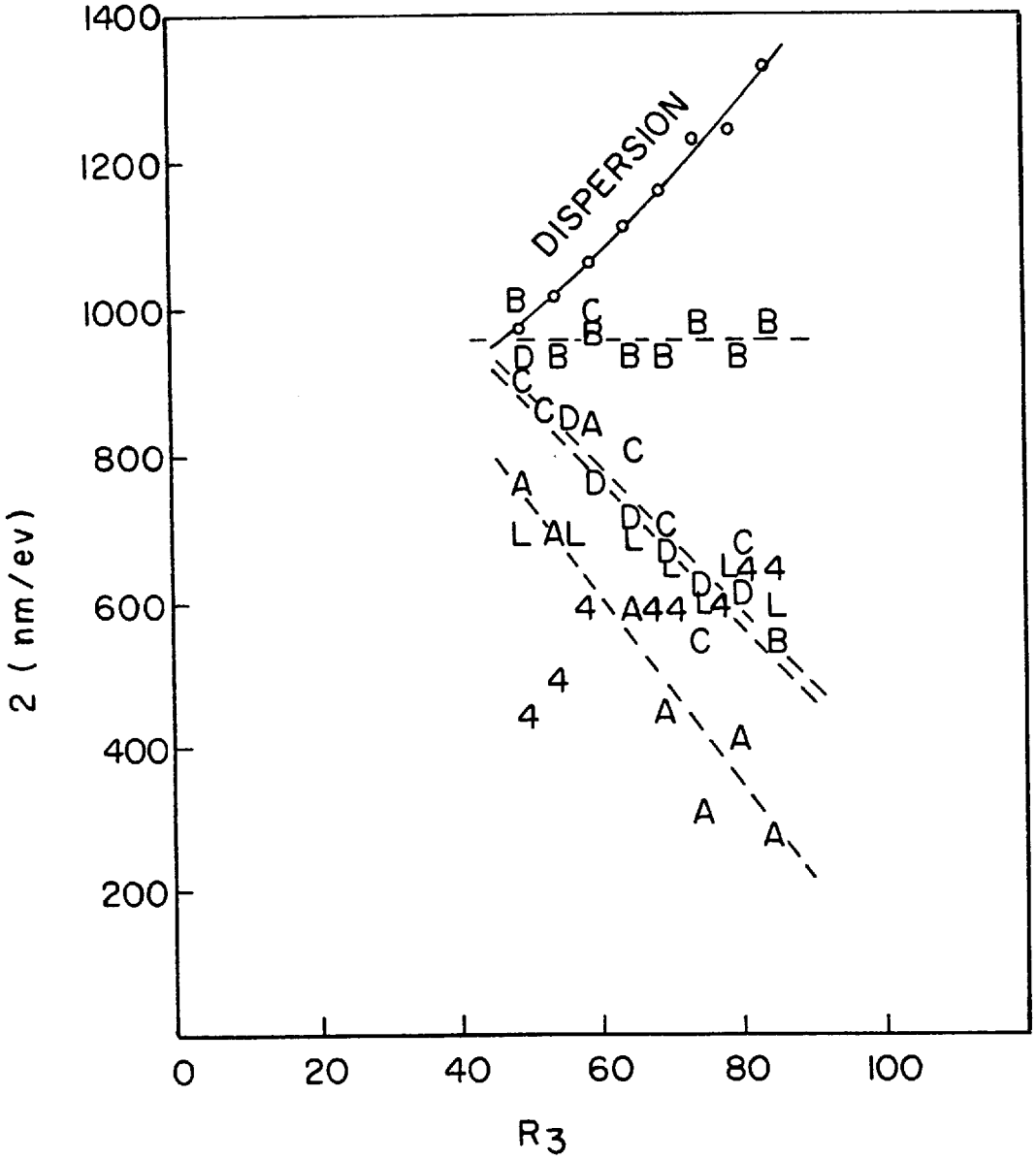
FIG. 5 is a graph illustrating the relations of second-order aberrations and energy dispersion to the sector radius $R_3$ of the magnet $M_3$ of the energy filter shown in FIGS. 1A and 1B.

FIG. 5 is a graph illustrating the relation of the second-order aberrations and energy dispersion to the sector radius $R_3$ (=$R_2$) of the magnet $M_3$ ($M_2$). The results of FIGS. 3 and 4 are shown together with the energy dispersion. If the sector radius $R_3$ is increased while maintaining the sector radius $R_4$ at 50 mm, the energy dispersion increases but the second-order aberrations decrease as a whole. However, only one second-order aberration, or $B_{GBE}$, does not decrease as the sector radius $R_3$ is increased. Accordingly, the geometry must be so selected that this aberration becomes 1000, for the following reason. The energy dispersion increases with increasing the distance $L_4$ and with reducing the distance LL as shown in FIGS. 3 and 4. Therefore, the distance $L_4$ and LL are so determined that the aberration $B_{GBB}$ assumes its critical value.

It can be understood from FIGS. 3 and 4 that a preferable range for the distance $L_4$ is given by 40 mm$\leqq L_4 \leqq$70 mm and that a preferable range for the distance LL is given by 55 mm$\leqq$LL$\leqq$90 mm.

Figure 6:
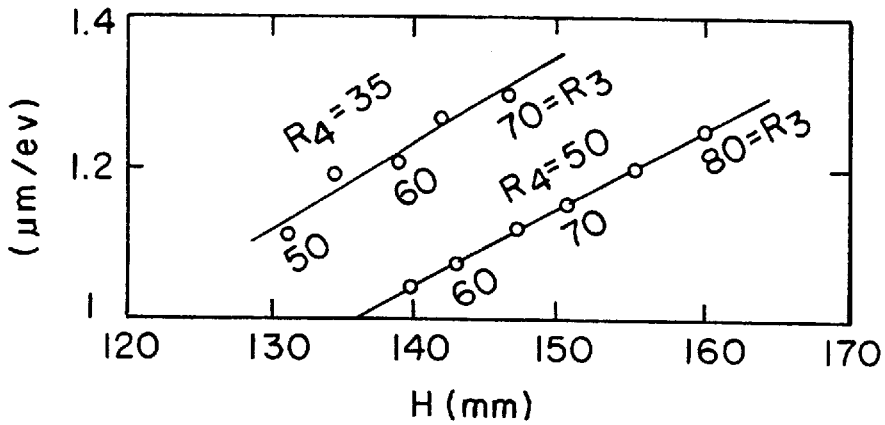
FIG. 6 is a graph illustrating the relation of energy dispersion to the rectilinear distance 2H between the aperture plane and the slit plane of the energy filter shown in FIGS. 1A and 1B.
Figure 7:
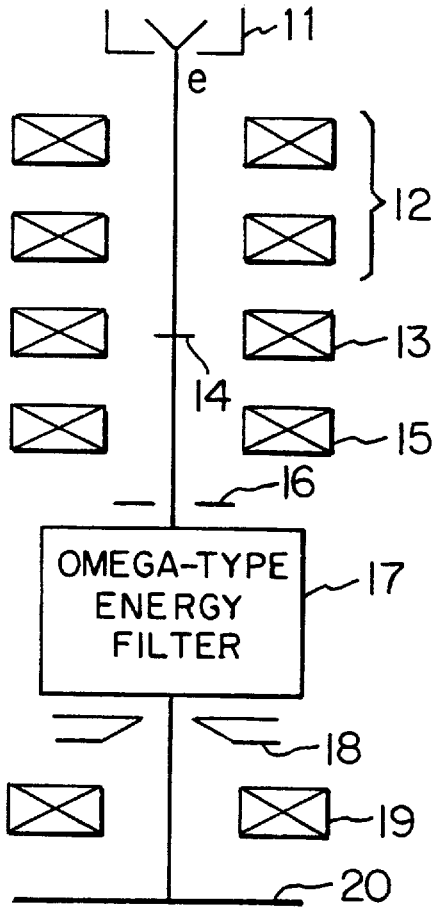
FIG. 7 is a block diagram of an electron microscope having electron optics incorporating an omega-type energy filter according to the invention.
Figure 8:
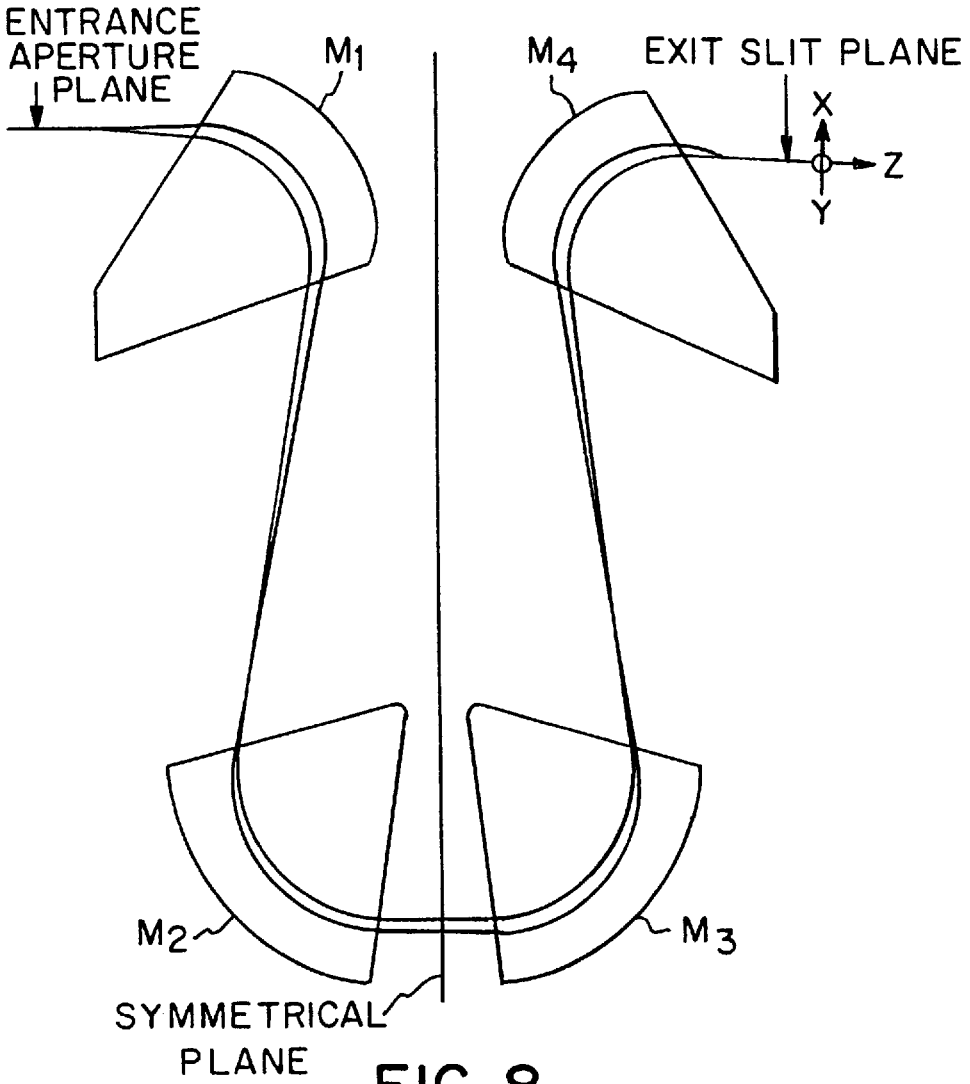
FIG. 8 PRIOR ART
FIG. 8 is an electron optical ray diagram illustrating the geometry of an A-type omega-type energy filter.
Figure 9:
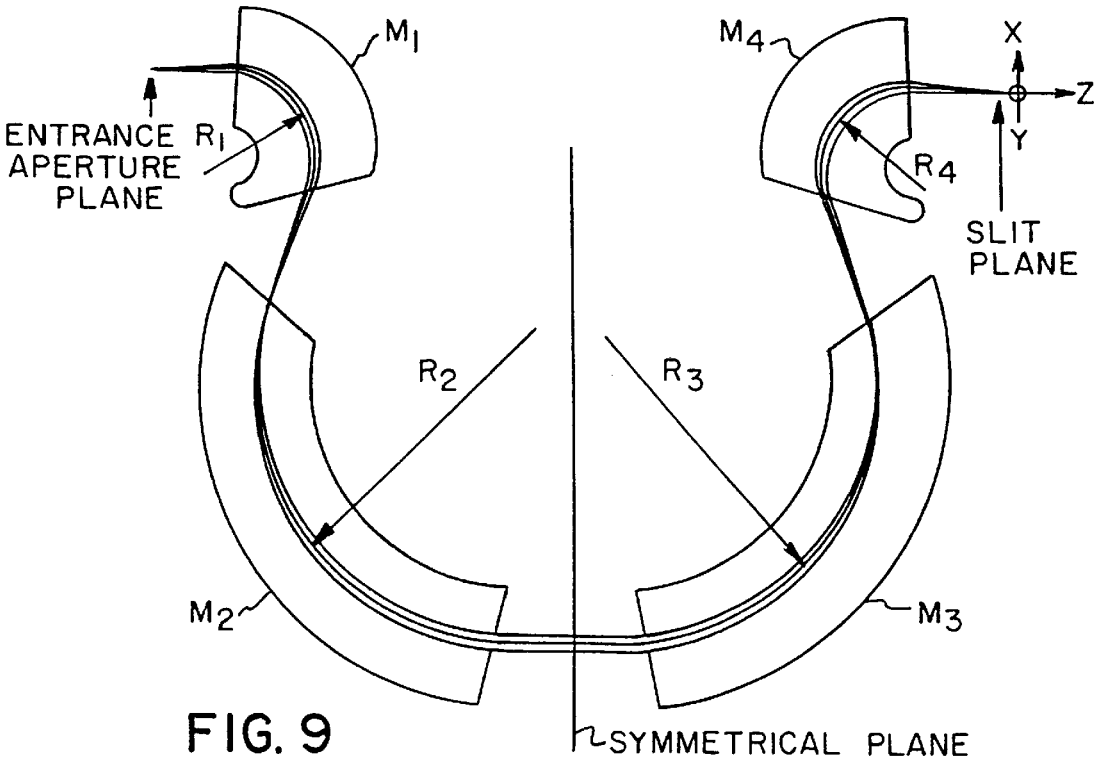
FIG. 9 PRIOR ART
FIG. 9 is an electron optical ray diagram illustrating the geometry of a B-type omega-type energy filter.

FIG. 6 is a graph illustrating the relation of the energy dispersion to the rectilinear distance 2H between the aperture plane and the slit plane of the energy filter shown in FIGS. 1A and 1B. In order to examine the effect of the sector radius $R_4$, two geometries having sector radii of 50 mm and 35 mm, respectively, were built, and they were compared. H plotted on the horizontal axis indicates the rectilinear distance from the symmetrical plane of the filter to the slit plane. 2H indicates the height of the filter. It can be said that for the same performance, the distance H should be reduced as small as possible. Plotted on the vertical axis is the energy dispersion. As described previously, the energy dispersion is so selected that every second-order aberration is less than 1000. As can be seen from the graph, the performance is improved with reducing the sector radius $R_4$. In practical applications, the sector radius $R_4$ is preferably set less than 50 mm.

It is to be noted that the above-described preferred values of the distance $L_5$, sector radius $R_4$, etc. have been determined under the condition that the accelerating voltage is 200 kV (relativistically modified accelerating voltage U*200 kV) . Where an arbitrary relativistically modified accelerating voltage U* kV is used, it is necessary to correct $$\sqrt{(U^*/239)}\ .$$

For example, in the case of the distance $L_5$, the range should be modified to $$50\text{ mm} \geqq L_5/\sqrt{(U^*/239)} \geqq 40\text{ mm}.$$

Similarly, other lengths are required to be corrected as follows:

$$55\text{ mm} \leqq LL/\sqrt{(U^*/239)} \leqq 90\text{ mm}$$

$$40\text{ mm} \leqq L_4/\sqrt{(U^*/239)} \leqq 70\text{ mm}$$

$$R_4/\sqrt{(U^*/239)} \leqq 50\text{ mm}$$

As described thus far, the present invention provides an omega-type energy filter in which charged-particles are focused three times in the x-direction, i.e., in a direction perpendicuLar to the magnetic field, and twice in the y-direction, i.e., in the field direction. This filter is characterized in that it produces small aberrations and large energy dispersion by satisfying the relations $$50\text{ mm} \geqq L_5/\sqrt{(U^*/239)} \geqq 40\text{ mm}$$

where $L_5$ is the distance between the entrance aperture and the entrance face of the sector magnet $M_1$ and, at the same time, is the distance between the exit face of the sector magnet $M_4$ and the exit slit.

What is claimed is:

1. An omega-type energy filter comprising:

an entrance aperture for entering a charged-particle beam accelerated at a relativistically modified accelerating voltage U* kV;

four sector magnets $M_1$, $M_2$, $M_3$, and $M_4$ for successively deflecting said entered charged-particle beam by producing magnetic fields in a y-direction and for directing said charged particle beam toward an exit slit, said entrance aperture and said exit slit being symmetrically arranged with respect to a central, symmetrical plane of said filter, said sector magnets $M_1$ and $M_4$ being symmetrically arranged with respect to said symmetrical plane, said sector magnets $M_2$ and $M_3$ being symmetrically arranged with respect to said symmetrical plane, said charged-particle beam being focused three times in an x-direction perpendicular to the direction of the magnetic fields and twice in the y-direction;

said sector magnets $M_2$ and $M_3$ facing the symmetrical plane are spaced from said sector magnets $M_1$ and $M_4$, respectively, by a distance of $L_1$, said sector magnets $M_1$ and $M_4$ facing said entrance aperture and said exit slit, respectively, and wherein said distance $L_4$ is so selected that relations given by $$40\text{ mm} \leqq L_4/\sqrt{(U^*/239)} \leqq 70\text{ mm}$$

are satisfied.

2. The omega-type energy filter of claim 1, wherein said sector magnets $M_2$ and $M_3$ have a sector radius of $R_3$ and said sector magnets $M_1$ and $M_4$ have a smaller sector radius of $R_4$ such that $R_3>R_4$.

3. The omega-type energy filter of claim 1, wherein said entrance aperture is spaced from a first image place by a distance of LL and said exit slit is spaced from an image plane located immediately ahead of said exit slit by the same distance of LL, and wherein said distance LL is so selected that relations given by $$55\text{ mm} \leqq LL/\sqrt{(U^*/239)} \leqq 90\text{ mm}$$

are satisfied.

4. The omega-type energy filter of claim 1, wherein said sector magnet $M_1$ having an entrance face which is spaced from said entrance aperture by a distance $L_5$;

said sector magnet $M_4$ having an exit face which is spaced from said exit slit by said distance of $L_5$; and said distance $L_5$ being so selected as to satisfy relations given by $$40\text{ mm} \leqq L_5/\sqrt{(U^*/239)} \leqq 50\text{ mm}.$$

5. The omega-type energy filter of claim 1, wherein said sector magnets $M_1$ and $M_4$ have a sector radius of $R_4$ which satisfies a relation given by $$R_4/\sqrt{(U^*/239)} \leqq 50\text{ mm}.$$

6. The omega-type energy filter of claim 1, wherein said sector magnet $M_2$ has an exit face tilted at an angle of $\theta_1$ to said charged particle beam, said sector magnet $M_3$ has an entrance face tilted at an angle of $\theta_1$ to said charged particle beam, said sector magnet $M_2$ has an entrance face tilted at an angle of $\theta_2$ to said charged particle beam, said sector magnet $M_3$ has an exit face tilted at an angle of $\theta_2$ to said charred particle beam, said sector magnet $M_1$ has an exit face tilted at an angle of $\theta_3$ to said charged particle beam, said sector magnet $M_4$ has an entrance face tilted at an angle of $\theta_3$ to said charged particle beam, said sector magnet $M_1$ has an entrance face tilted at an angle of $\theta_4$ to said charged particle beam, said sector magnet $M_4$ has an exit face tilted at an angle of $\theta_4$ to said charged particle beam, and all of these four angles $\theta_1$–$\theta_4$ are greater than −10° and less than 45°.

* * * * *

UNITED STATES PATENT AND TRADEMARK OFFICE

CERTIFICATE OF CORRECTION

PATENT NO. : 5,811,801

DATED : September 22, 1998

INVENTOR(S) : Katsushige Tsuno

It is certified that error appears in the above-identified patent and that said Letters Patent is hereby corrected as shown below:

Title Page, insert:

--[30] Foreign Application Priority Data

Nov. 28, 1995 [JP] Japan.....7-309050--.

Column 1 Lines 55-56

"(slit plane)

. In"

should read

--(slit plane).

In--.

Column 1 Line 57 "(imaging planes)" should read --(imaging plane)--.

Figures 10A, 10B, 10C, 10D:
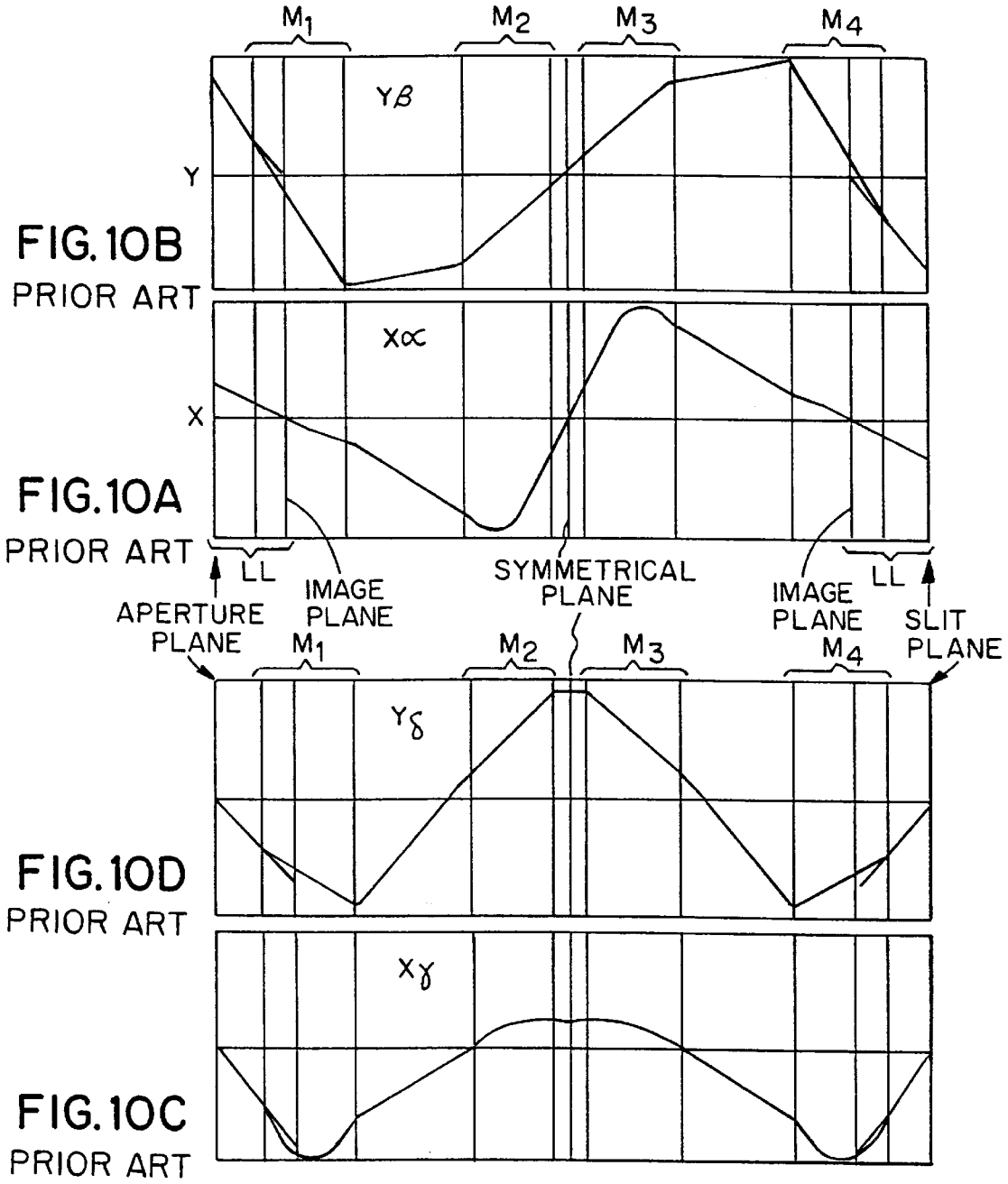
FIG. 10B PRIOR ART
FIG. 10A PRIOR ART
FIG. 10D PRIOR ART
FIG. 10C PRIOR ART
FIGS. 10A, 10B, 10C and 10D are graphs illustrating four kinds of electron orbits $x\alpha$, $y\beta$, $x\gamma$, and $y\delta$ of the geometry of FIG. 8.
Figures 11A, 11B, 11C, 11D:
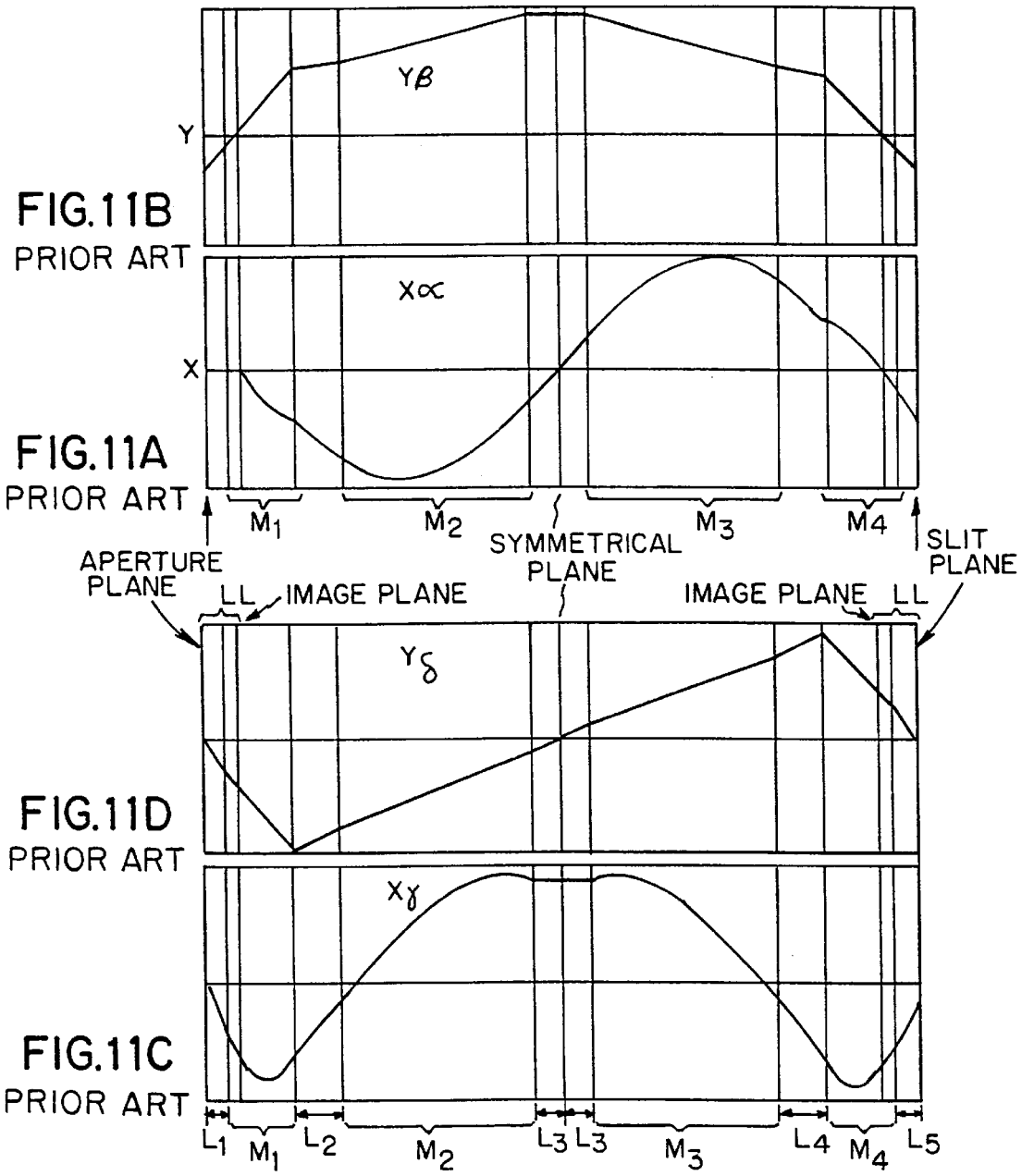
FIG.11B PRIOR ART
FIG.11A PRIOR ART
FIG.11D PRIOR ART
FIG.11C PRIOR ART
FIGS. 11A, 11B, 11C and 11D are graphs illustrating four kinds of electron orbits $x\alpha$, $y\beta$, $x\gamma$, and $y\delta$ of the geometry of FIG. 9.

Column 1 Line 60 "FIG. 10" should read --FIGS. 10A and 10B--.

Column 2 Line 17 "is so adjusted" should read --are so adjusted--.

Column 2 Line 31 "FIG. 10C and 10D" should read --FIGS. 10C and 10D--.

Column 3 Line 62 "own" should read --shown--.

Column 4 Line 31 "1 $\mu$ it m/eV" should read --1 $\mu$ m/eV--.

Column 4 Line 46 "centeir" should read --center--.

Column 4 Line 59 "image place" should read --image plane--.

Column 5 Line 32 "Springer 1995" should read --Spring 1995--.

Column 5 Line 33 "Krahl.," should read --Krahl,-- (delete period).

UNITED STATES PATENT AND TRADEMARK OFFICE

CERTIFICATE OF CORRECTION

PATENT NO. : 5,811,801

DATED : September 22, 1998

INVENTOR(S) : Katsushige Tsuno

It is certified that error appears in the above-identified patent and that said Letters Patent is hereby corrected as shown below:

Column 5 Line 43 "Ml" should read --$M_1$--.

Column 6 Line 35 "$B_{GBE}$" should read --$B_{GBB}$--.

Column 7 Line 1 "U*200 kV" should read --$U^*_{200kV}$--.

Column 7 Line 26 "perpendicuLar" should read --perpendicular--.

Claim 1 Column 7 Line 58 "$L_1$" should read --$L_4$--.

Claim 3 Column 8 Line 11 "image place" should read --image plane--.

Claim 6 Column 8 Line 48 "charred" should read --charged--.

Signed and Sealed this

Fourth Day of May, 1999

*Attest:*

*Attesting Officer*

Q. TODD DICKINSON

*Acting Commissioner of Patents and Trademarks*